US009144305B1

(12) United States Patent
Collins, Jr.

(10) Patent No.: US 9,144,305 B1
(45) Date of Patent: Sep. 29, 2015

(54) PORTABLE FOOD DISPLAY DEVICE HAVING MULTIPLE RODENT-PROOF SEALED COMPARTMENTS AND WHEELS

(71) Applicant: Robert Collins, Jr., Lynnfield, MA (US)

(72) Inventor: Robert Collins, Jr., Lynnfield, MA (US)

( * ) Notice: Subject to any disclaimer, the term of this patent is extended or adjusted under 35 U.S.C. 154(b) by 0 days.

(21) Appl. No.: 14/294,486

(22) Filed: Jun. 3, 2014

(51) Int. Cl.
*A47B 87/02* (2006.01)
*A47B 71/00* (2006.01)
*A47B 47/00* (2006.01)

(52) U.S. Cl.
CPC ..... *A47B 71/00* (2013.01); *A47B 47/0091* (2013.01); *A47B 87/0292* (2013.01)

(58) Field of Classification Search
CPC .... A47B 45/00; A47B 47/00; A47B 47/0066; A47B 47/0091; A47B 87/02; A47B 87/0215; A47B 87/0292; A47B 87/0284; A47B 71/00
USPC ..... 312/3, 4, 5, 6, 100, 107, 108, 128, 198, 312/351.2, 351.3
See application file for complete search history.

(56) References Cited

U.S. PATENT DOCUMENTS 470,152 A * 3/1892 Buechele ..... 312/107
1,321,097 A * 11/1919 Gonzalez ..... 217/45
2,381,598 A 8/1945 Welton
2,535,528 A * 12/1950 Brodbeck ..... 126/305
3,632,038 A * 1/1972 Souza ..... 229/125.19
4,426,120 A * 1/1984 Johnson et al. ..... 312/100
4,500,146 A * 2/1985 Peterson ..... 312/257.1
4,818,044 A * 4/1989 Dobry ..... 312/257.1
5,622,415 A * 4/1997 Felsenthal et al. ..... 312/265.4
5,678,904 A * 10/1997 Hung ..... 312/3
5,890,613 A 4/1999 Williams
5,967,323 A 10/1999 Siragusa
D433,285 S 11/2000 Camp, Jr.
6,890,045 B2 * 5/2005 Klassen ..... 312/351.3
D594,232 S 6/2009 Wyse
2002/0171332 A1 * 11/2002 Skov et al. ..... 312/107
2008/0011697 A1 1/2008 Berg
2009/0314021 A1 12/2009 Higgs
2011/0302945 A1 12/2011 Howington

* cited by examiner

*Primary Examiner* — James O Hansen
(74) *Attorney, Agent, or Firm* — Kyle A. Fletcher, Esq.

(57) ABSTRACT

The storage assembly includes a lower housing that is positionable on a support surface. The lower housing insertably receives a shelving unit. The shelving unit stands within the lower housing. An upper housing is positionable on the lower housing. The upper housing encompasses the shelving unit. The upper housing is open so the shelving unit is accessible. A door is operationally coupled to the upper housing. The door closes the upper housing.

18 Claims, 6 Drawing Sheets

PORTABLE FOOD DISPLAY DEVICE HAVING MULTIPLE RODENT-PROOF SEALED COMPARTMENTS AND WHEELS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of portable food display devices, more specifically, portable food display devices having multiple rodent-proof sealed compartments and wheels.

SUMMARY OF THE INVENTION

An embodiment of the disclosure meets the needs presented above by generally comprising a lower housing that is positionable on a support surface. The lower housing insertably receives a shelving unit. The shelving unit stands within the lower housing. An upper housing is positionable on the lower housing. The upper housing encompasses the shelving unit. The upper housing is open so the shelving unit is accessible. A door is operationally coupled to the upper housing. The door closes the upper housing.

An object of the invention is to provide a device that is portable food display device having multiple rodent-proof sealed compartments and wheels.

These together with additional objects, features and advantages of the portable food display device having multiple rodent-proof sealed compartments and wheels will be readily apparent to those of ordinary skill in the art upon reading the following detailed description of presently preferred, but nonetheless illustrative, embodiments of the portable food display device having multiple rodent-proof sealed compartments and wheels when taken in conjunction with the accompanying drawings.

In this respect, before explaining the current embodiments of the portable food display device having multiple rodent-proof sealed compartments and wheels in detail, it is to be understood that the portable food display device having multiple rodent-proof sealed compartments and wheels is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable food display device having multiple rodent-proof sealed compartments and wheels.

It is therefore important that the claims be regarded as including such equivalent construction insofar as they do not depart from the spirit and scope of the portable food display device having multiple rodent-proof sealed compartments and wheels. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
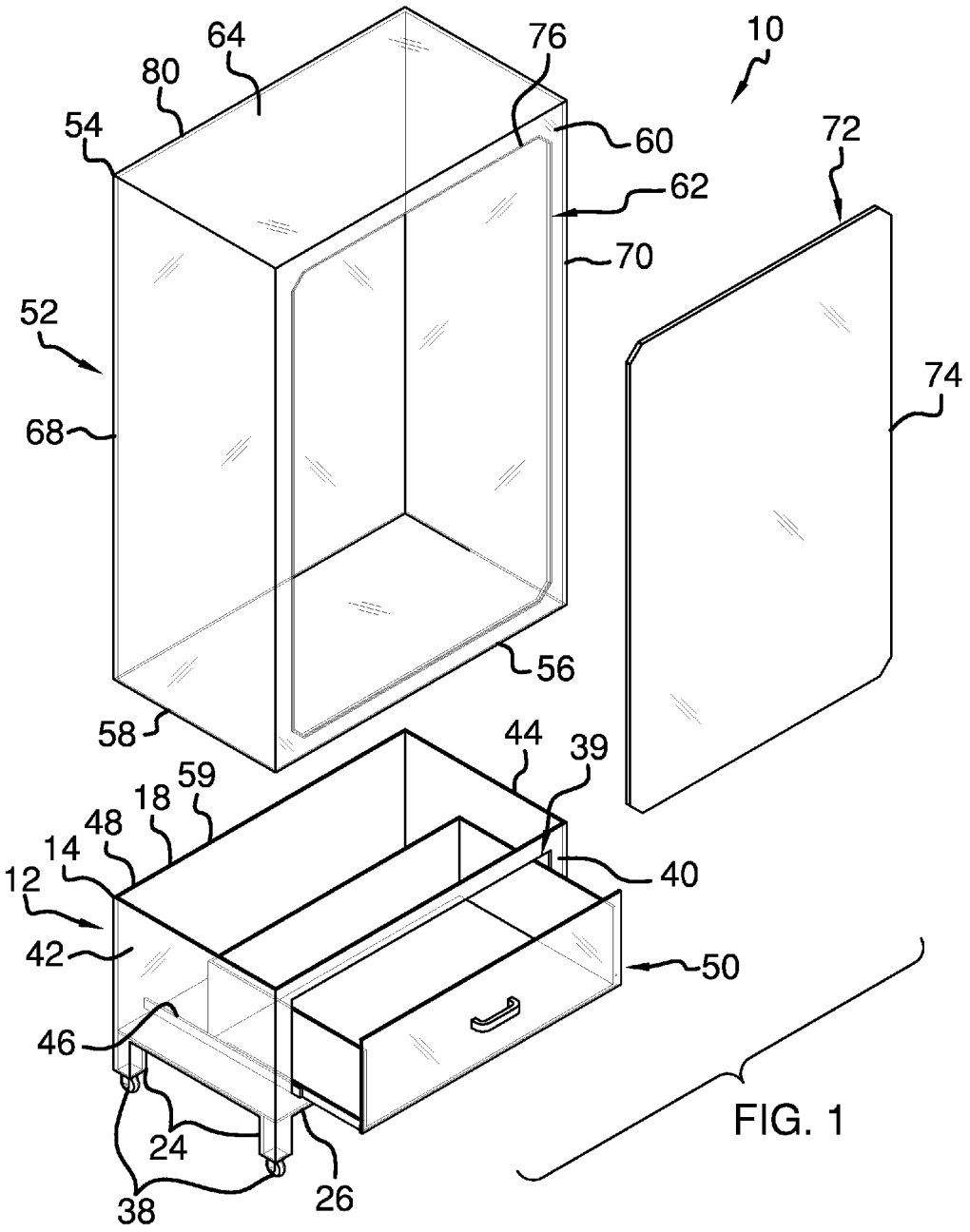
FIG. 1 is a front perspective view of a storage assembly according to an embodiment of the disclosure.
Figure 2:
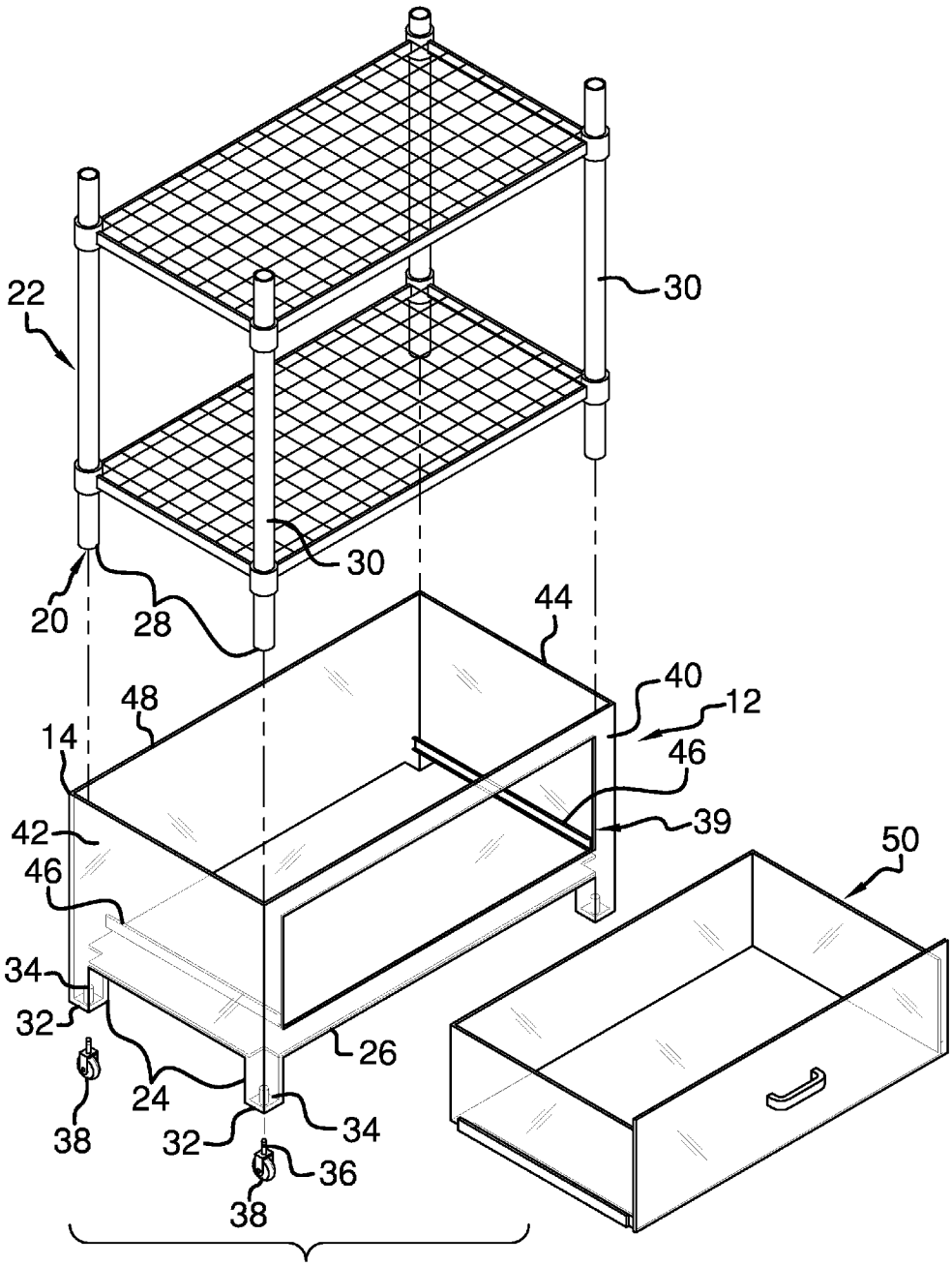
FIG. 2 is an exploded front perspective view of an embodiment of the disclosure.
Figure 3:
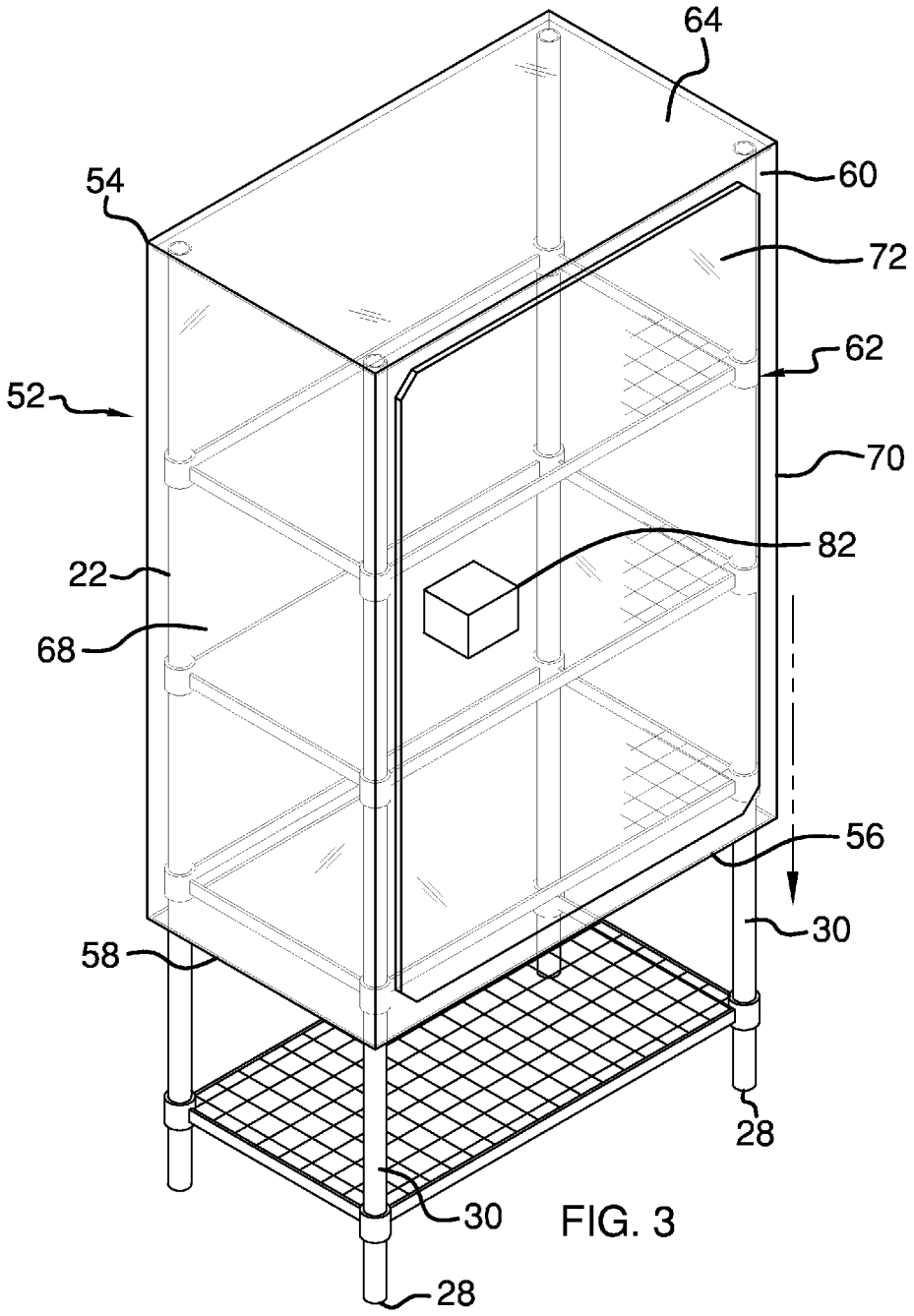
FIG. 3 is a top perspective view of an embodiment of the disclosure.
Figure 4:
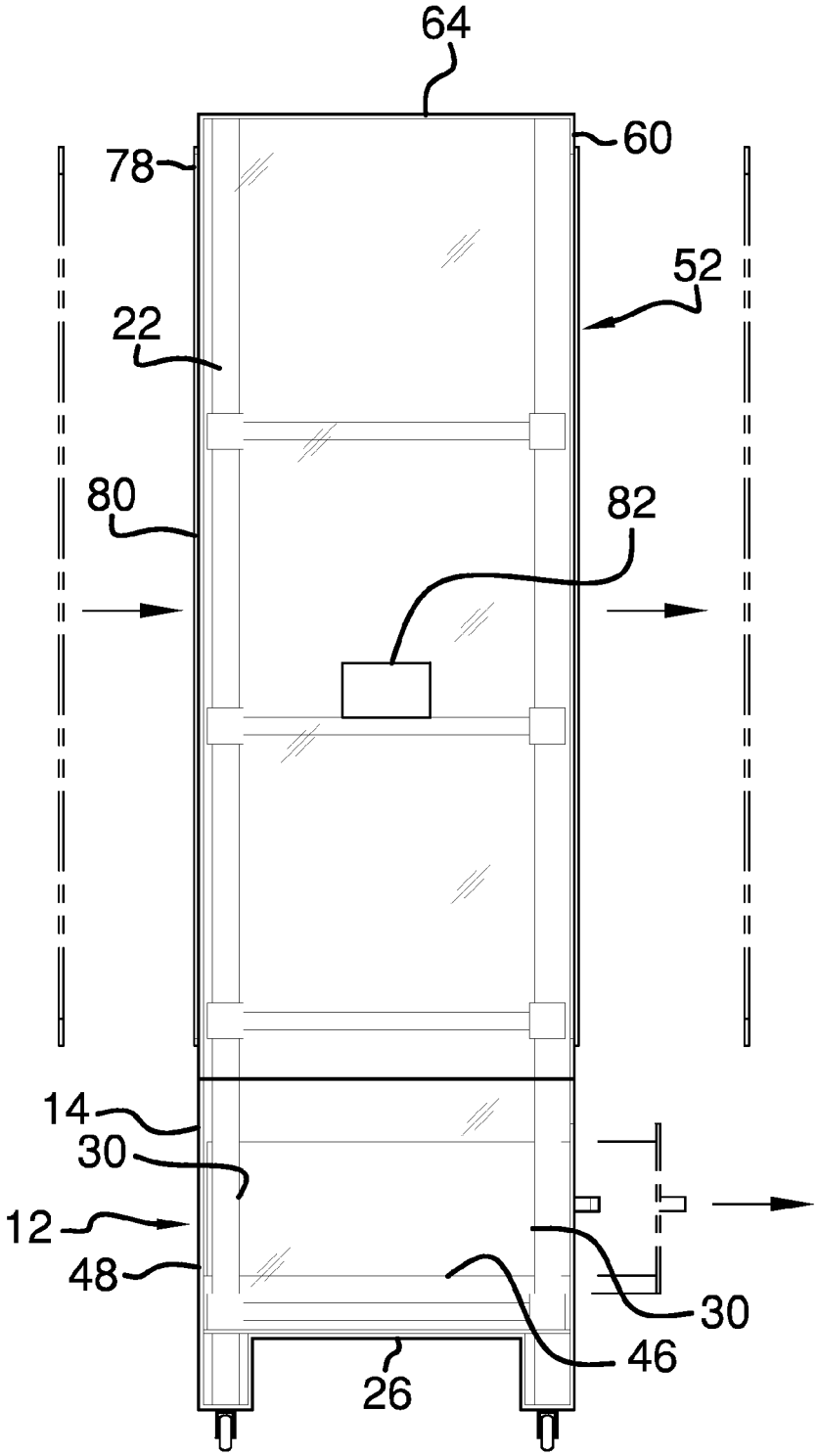
FIG. 4 is a right side view of an embodiment of the disclosure.
Figure 5:
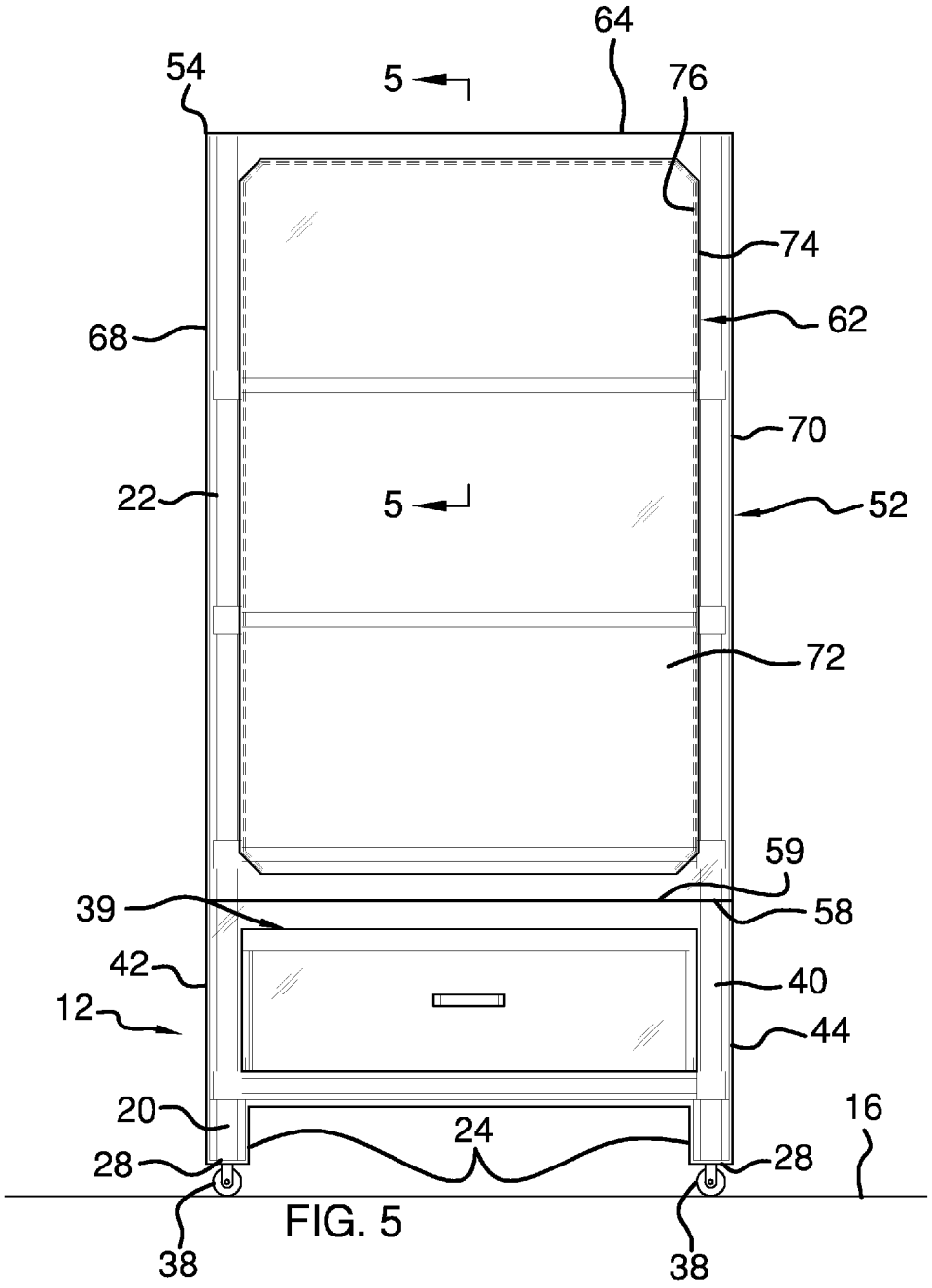
FIG. 5 is a front view of an embodiment of the disclosure.
Figure 6:
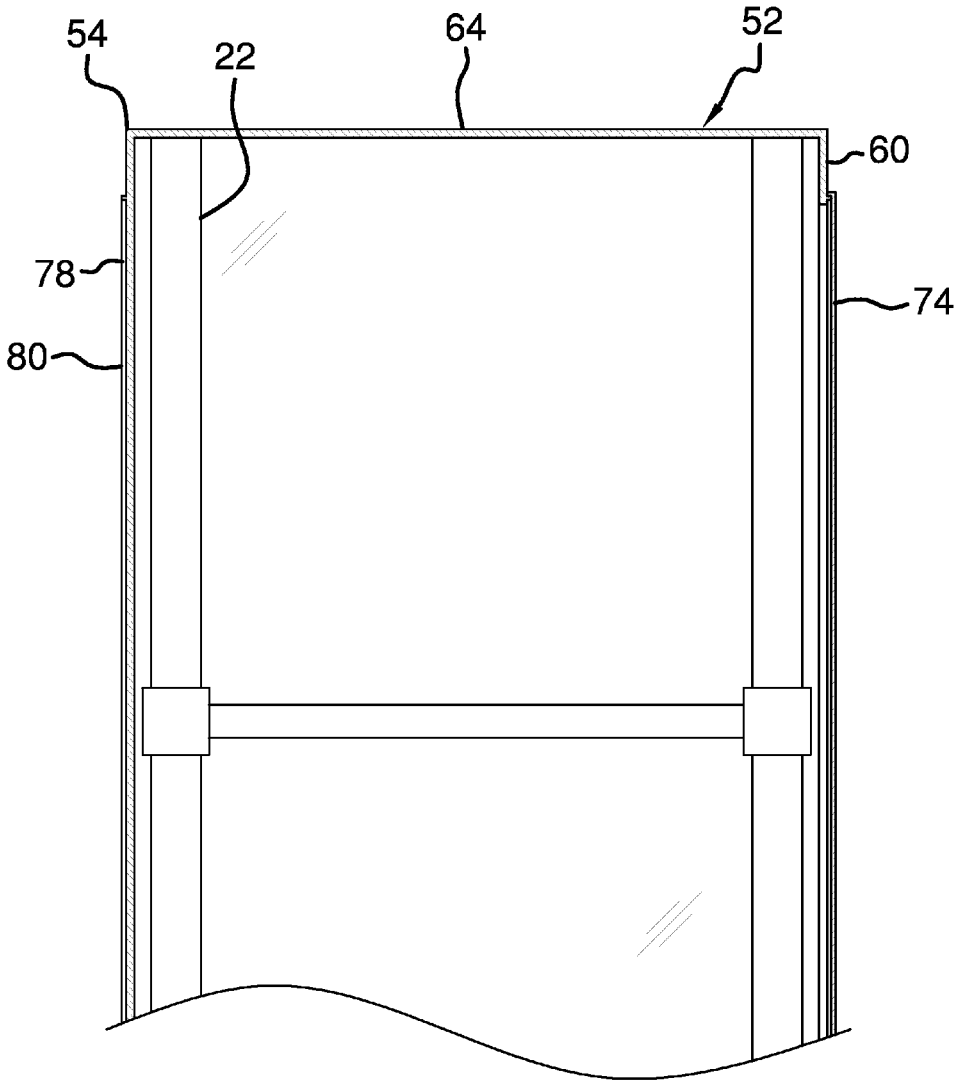
FIG. 6 is a cross sectional view taken along line 6-6 of FIG. 5 of an embodiment of the disclosure.

As best illustrated in FIGS. 1 through 6, the storage assembly 10 generally comprises a lower housing 12. An outer wall 14 of the lower housing 12 has a length that is greater than a width of the outer wall 14 of the lower housing 12. The lower housing has 12 a rectangular parallelepiped shape. Additionally, the lower housing 12 may be comprised of a translucent and fluid impermeable material.

The lower housing 12 is positionable on a support surface 16. The support surface 16 may be ground. A top side 18 of the outer wall 14 of the lower housing 12 is open. A lower end 20 of a shelving unit 22 is positionable within the lower housing 12. The shelving unit 22 may be a free standing shelving unit of any conventional design.

A plurality of legs 24 extends downwardly from a bottom side 26 of the outer wall 14 of the lower housing 12. Each of the plurality of legs 24 is positioned proximate an associated one of four corners of the bottom side 26 of the outer wall 14 of the lower housing 12. Moreover, each of the plurality of legs 24 is substantially hollow. An interior of the plurality of legs 24 is in fluid communication with an interior of the lower housing 12. A lowermost end 28 of each of a plurality of legs 30 of the shelving unit 22 is positionable within each of the plurality of legs 24 on the lower housing 12. The shelving unit 22 extends upwardly through the open top side 18 of the lower housing 12.

A bottommost side 32 of each of the plurality of legs 24 on the lower housing 12 has a wheel well 34 extending upwardly therein. A peg 36 on each of a plurality of wheels 38 is insertable into an associated one of the plurality of wheel wells 34. The plurality of wheels 34 abuts the support surface 16. Moreover, the lower housing 12 is rollable along the support surface 16.

A hole 39 extends through a front side 40 of the outer wall 14 of the lower housing 12. The hole 39 extends between the top side 18 and the bottom side 26 of the outer wall 14 of the lower housing 12. Additionally, the hole 39 extends between a first oblique side 42 and a second oblique side 44 of the outer wall 14 of the lower housing 12.

A pair of rails 46 each extends between the front side 40 and a rear side 48 of the outer wall 14 of the lower housing 12. The pair of rails 46 are each positioned on opposite sides of the hole 39 in the lower housing 12. A drawer 50 is slidably coupled to the pair of rails 46. The drawer 50 is extendable forwardly from the front side 40 of the outer wall 14 of the lower housing 12. Moreover, the drawer 50 is positionable between an open position and a closed position.

An upper housing 52 is provided. An exterior wall 54 of the upper housing 52 has a height that is greater than a width of the exterior wall 54 of upper housing 52. The upper housing 52 has a rectangular parallelepiped shape. Moreover, the upper housing 52 may be comprised of a translucent and fluid impermeable material.

A lower side 56 of the exterior wall 54 of the upper housing 52 is open. The lower side 56 of the exterior wall 54 of the upper housing 52 is positionable on the top side 18 of the outer wall 14 of the lower housing 12. A bottom edge 58 of the upper housing 52 is coextensive with a top edge 59 of the lower housing 12. Additionally, the upper housing 52 extends upwardly from the lower housing 12. The upper housing 52 encompasses the shelving unit 22.

A front side 60 of the exterior wall 54 of the upper housing 52 has an opening 62 extending therethrough. The opening 62 extends between a upper side 64 and the lower side 56 of the exterior wall 54 of the upper housing 52. The opening 62 further extends between a first lateral side 68 and a second lateral side 70 of the exterior wall 54 of the upper housing 52. A door 72 is positionable within the opening 62. An outer edge 74 of the door 72 engages a bounding edge 76 of the opening 62 so the door 72 closes the opening 62.

A lip 78 is coupled to a back side 80 of the exterior wall 54 of the upper housing 52. The lip 78 extends between the upper side 64 and the lower side 56 of the exterior wall 54 of the upper housing 52. The door 72 is positionable so the outer edge 74 of the door 72 engages the lip 78. Moreover, the door 72 is positionable on the lip 78 so the door 72 may be stored.

In use, the shelving unit 22 is positioned within the lower housing 12. The upper housing 52 is positioned over the shelving unit 22. The door 72 is removed from the opening 62 to gain access to the shelving unit 22 when an item 82 is to be retrieved from the shelving unit 22. The shelving unit 22 is visible through both of the upper 52 and lower 12 housings. The assembly 10 prevents rodents from accessing the shelving unit 22.

With respect to the above description, it is to be realized that the optimum dimensional relationship for the various components of the storage assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the storage assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A storage assembly configured to cover a shelving unit such that the shelving unit is inaccessible to rodents, said assembly comprising:

a lower housing positionable on a support surface, said lower housing insertably receiving the shelving unit such that the shelving unit stands within said lower housing;

an upper housing positionable on said lower housing such that said upper housing encompasses the shelving unit, said upper housing being open such that the shelving unit is accessible;

a door operationally coupled to said upper housing such that said door closes said upper housing;

wherein a lowermost end of each of a plurality of legs of the shelving unit being positionable within each of a plurality of legs on said lower housing such that the shelving unit extends upwardly through an open top side of said lower housing.

2. The assembly according to claim 1, wherein an outer wall of said lower housing having a length being greater than a width of said outer wall of said lower housing such that said lower housing has a rectangular parallelepiped shape.

3. The assembly according to claim 1, wherein a top side of an outer wall of said lower housing being open such that a lower end of the shelving unit is positionable within said lower housing.

4. The assembly according to claim 1, wherein a plurality of legs extending downwardly from a bottom side of an outer wall of said lower housing.

5. The assembly according to claim 4, wherein each of said plurality of legs being positioned proximate an associated one of four corners of said bottom side of said outer wall of said lower housing.

6. The assembly according to claim 4, wherein each of said plurality of legs being substantially hollow such that an interior of said plurality of legs is in fluid communication with an interior of said lower housing.

7. The assembly according to claim 1, wherein a drawer slidably coupled to said lower housing such that said drawer is extendable forwardly from a front side of an outer wall of said lower housing.

8. The assembly according to claim 7, wherein said drawer being positionable between an open position and a closed position.

9. The assembly according to claim 1, wherein an exterior wall of said upper housing having a height being greater than a width of said exterior wall of said upper housing such that said upper housing has a rectangular parallelepiped shape.

10. The assembly according to claim 1, wherein a lower side of an exterior wall of said upper housing being open.

11. The assembly according to claim 1, wherein a lower side of an exterior wall of said upper housing being positionable on a top side of an outer wall of said lower housing having a bottom edge of said upper housing being coextensive with a top edge of said lower housing such that said upper housing extends upwardly from said lower housing such.

12. The assembly according to claim 1, wherein a front side of an exterior wall of said upper housing having an opening extending therethrough.

13. The assembly according to claim 12, wherein said opening extending between an upper side and a lower side of an exterior wall of said upper housing, said opening further extending between a first lateral side and a second lateral side of said exterior wall of said upper housing.

14. The assembly according to claim 1, wherein said door being positionable within an opening having an outer edge of said door engaging a bounding edge of said opening such that said door closes said opening.

15. A storage assembly configured to cover a shelving unit such that the shelving unit is inaccessible to rodents, said assembly comprising:

a lower housing, an outer wall of said lower housing having a length being greater than a width of said outer wall of said lower housing such that said lower housing has a rectangular parallelepiped shape, said lower housing being positionable on a support surface, said lower housing insertably receiving the shelving unit such that the shelving unit stands within said lower housing;

an upper housing positionable on said lower housing such that said upper housing encompasses the shelving unit, said upper housing being open such that the shelving unit is accessible;

a door operationally coupled to said upper housing such that said door closes said upper housing;

wherein a lowermost end of each of a plurality of legs of the shelving unit being positionable within each of a plurality of legs on said lower housing such that the shelving unit extends upwardly through an open top side of said lower housing; a drawer slidably coupled to said lower housing such that said drawer is extendable forwardly from a front side of said outer wall of said lower housing; said drawer being positionable between an open position and a closed position.

16. The assembly according to claim 15, wherein a top side of said outer wall of said lower housing being open such that a lower end of the shelving unit is positionable within said lower housing; a plurality of legs extending downwardly from a bottom side of said outer wall of said lower housing; each of said plurality of legs being positioned proximate an associated one of four corners of said bottom side of said outer wall of said lower housing; each of said plurality of legs being substantially hollow such that an interior of said plurality of legs is in fluid communication with an interior of said lower housing.

17. The assembly according to claim 15, wherein an exterior wall of said upper housing having a height being greater than a width of said exterior wall of said upper housing such that said upper housing has a rectangular parallelepiped shape; a lower side of said exterior wall of said upper housing being open; said lower side of said exterior wall of said upper housing being positionable on a top side of said outer wall of said lower housing having a bottom edge of said upper housing being coextensive with a top edge of said lower housing such that said upper housing extends upwardly from said lower housing.

18. The assembly according to claim 15, wherein a front side of an exterior wall of said upper housing having an opening extending therethrough; said opening extending between an upper side and a lower side of said exterior wall of said upper housing; said opening further extending between a first lateral side and a second lateral side of said exterior wall of said upper housing; said door being positionable within said opening having an outer edge of said door engaging a bounding edge of said opening such that said door closes said opening.

* * * * *